US008340331B2

(12) United States Patent
Pansell et al.

(10) Patent No.: US 8,340,331 B2
(45) Date of Patent: Dec. 25, 2012

(54) COMMUNICATION SYSTEM

(75) Inventors: August Pansell, Halmstad (SE); Carljohan Lagervall, Halmstad (SE)

(73) Assignee: Carj Develpment Limited, Msida (MT)

( * ) Notice: Subject to any disclaimer, the term of this patent is extended or adjusted under 35 U.S.C. 154(b) by 1074 days.

(21) Appl. No.: 12/090,234

(22) PCT Filed: Oct. 18, 2006

(86) PCT No.: PCT/SE2006/001184

§ 371 (c)(1),
(2), (4) Date: Sep. 16, 2008

(87) PCT Pub. No.: WO2007/046748

PCT Pub. Date: Apr. 26, 2007

(65) Prior Publication Data

US 2009/0003637 A1 Jan. 1, 2009

(30) Foreign Application Priority Data

Oct. 18, 2005 (SE) ..... 0502328

(51) Int. Cl.
*H04R 25/00* (2006.01)

(52) U.S. Cl. ..... 381/314; 381/315

(58) Field of Classification Search ..... 381/314, 381/315

See application file for complete search history.

(56) References Cited

U.S. PATENT DOCUMENTS

| | | | | |
|---|---|---|---|---|
| 5,365,590 | A | 11/1994 | Brame | |
| 7,284,123 | B2 * | 10/2007 | Kim | 713/163 |
| 7,404,001 | B2 * | 7/2008 | Campbell et al. | 709/231 |
| 2002/0131614 | A1 * | 9/2002 | Jakob et al. | 381/314 |
| 2003/0045283 | A1 | 3/2003 | Hagedoorn | |
| 2003/0064746 | A1 | 4/2003 | Radar et al. | |
| 2003/0165239 | A1 | 9/2003 | Bantz et al. | |
| 2005/0094838 | A1 | 5/2005 | Tomoda et al. | |
| 2005/0138654 | A1 * | 6/2005 | Minne | 725/31 |
| 2008/0304685 | A1 * | 12/2008 | Fideler | 381/323 |
| 2011/0090837 | A1 * | 4/2011 | Duchscher et al. | 370/312 |

FOREIGN PATENT DOCUMENTS

| | | | |
|---|---|---|---|
| EP | 1460769 | A1 | 9/2004 |
| EP | 1531650 | A2 | 5/2005 |
| EP | 1638367 | A2 | 3/2006 |

OTHER PUBLICATIONS

Haartsen J: "Bluetooth—The Universal Radio Interface for ad hoc, Wireless Connectivity" Ericcson Review (Incl. On), Telefonaktiebolaget L M Ericsson, SE, No. 3, Jan. 1, 1998, pp. 110-117, XP000783249, ISSN: 0014-0171.

* cited by examiner

*Primary Examiner* — Alexander Jamal
(74) *Attorney, Agent, or Firm* — Volpe and Koenig, P.C.

(57) ABSTRACT

A system for assisting a hearing impaired user is presented. The system includes a transmitter to transmit data representing audio intended to be heard by a hearing impaired person, the transmitter paired with at least one intended receiver. The transmitter includes: an analogue-to-digital converter to convert an analogue audio signal into digitally represented audio data, and a transmitter to transmit the digitally represented audio data in a radio signal on an active channel selected from a plurality of channels. The system also includes a receiver to receive data representing audio to be heard by the hearing impaired person, the receiver paired with the transmitter device. The receiver includes a receiver to receive the radio signal containing the digitally represented audio data, the radio signal being received from the transmitter on the active channel, and a digital-to-analogue converter to convert the digitally represented audio data into an analogue audio signal.

14 Claims, 5 Drawing Sheets

COMMUNICATION SYSTEM

FIELD OF THE INVENTION

The present invention relates to radio transmission systems, and more particularly to a radio transmission system to assist people being hearing impaired.

BACKGROUND OF THE INVENTION

Wireless Frequency Modulated (FM) radio transmissions are used for several purposes. For example, FM transmissions are used to allow and assist communication in cordless phones, walkie-talkies and baby monitors. One particular use is to use FM transmissions to assist the situation for people being hearing impaired. The equipment commonly comprises a transmitter, which captures a sound from the person speaking, and transmits the sound using an FM signal from the transmitter to a receiver carried by a user. The receiver is able to convert the FM signal to a sound, typically using some type of earpiece, allowing the user to hear the person speaking more clearly. This type of transmission system is crucial to allow the user to handle situations like lectures, meetings, television, radio and theatre.

One problem with the transmission systems in the prior art, is that transmissions may easily be received by non-intended users, preventing private meetings to be held securely. Moreover, because the signal is typically transmitted on a relatively low frequency, large and bulky antennas are required, leading to inconveniently large transmitters and, more importantly, large and bulky receivers.

SUMMARY OF THE INVENTION

In view of the above, an objective of the invention is to solve or at least reduce the problems discussed above. More specifically, a purpose of the invention is to provide a transmitter device, a receiver device and a system to convey data representing audio intended to be heard by a hearing impaired person.

Generally, the above objectives and purposes are achieved by an invention according to the attached independent patent claims. A first aspect of the invention is a transmitter device configured to transmit data representing audio intended to be heard by a hearing impaired person, the transmitter being capable of being paired with at least one intended receiver, the transmitter comprising: an analogue-to-digital converter configured to convert an analogue audio signal into digitally represented audio data, and a transmitter configured to transmit the digitally represented audio data in a radio signal on an active channel selected from a plurality of channels. This allows hearing impaired persons to receive a clear audio representing signal which is more difficult for non-intended users to hear.

The transmitter device may further comprise encryption means, the encryption means being capable of encrypting the digitally represented data. Encryption provides an even more secure way to transfer audio data to the hearing impaired person.

The encryption means may use an encryption key to encrypt the digitally represented data. The encryption key may be one of a plurality of possible encryption keys. Using encryption keys allows different keys to be used in different circumstances, providing an even higher security.

The transmitter device may further comprise a control data controller. The control data controller may be capable of sending a control signal to the at least one intended receiver.

Control data provides a way for the receiver to conveniently receive configurations with minimum user action.

The transmitter device may be capable of transmitting the control signal using a radio signal while continuing to transmit audio data. Consequently, the audio data is never interrupted.

The transmitter device may be configured to multiplex the control signal and the transmit audio data using time slots. Time slots is a stable way to multiplex data on one channel. Consequently only one receiver is required in the receiver device.

The transmitter device may further be capable of transmitting a decryption key matching the encryption key to the at least one intended receiver using the control signal. Transmitting the key using the control signal is simple and user friendly.

The transmitter device may be capable of transmitting an identity of the active channel to the at least one intended receiver using the control signal. Transmitting the channel id using the control signal is simple and user friendly.

The transmitter device may further comprise event detection means, the event detection means comprising an event microphone, the event detection means further being configured to generate an event signal to be transmitted using the control signal, if an audio signal detected using the event microphone has strength higher than a threshold value. Transmitting the event data using the control signal prevents the event data from interrupting normal audio transmission, e.g. from a television.

The transmitter device may further comprise an encoder capable of generating continuously variable slope delta (CVSD) coded audio data. CVSD provides acceptable audio even with a limited amount of bit errors.

The transmitter device may be configured to receive audio input from at least one source selected from the group consisting of an omnidirectional microphone, a unidirectional microphone, a speaker, a television, a mobile telephone, a digital enhanced cordless telecommunications (DECT) telephone, a public switched telephone network (PSTN) telephone, and a general purpose line-in connector. All the different inputs may advantageously be used with the present invention.

A second aspect of the invention is a receiver device configured to receive data representing audio intended to be heard by a hearing impaired person, the receiver device being capable of being paired with a transmitter device, the receiver device comprising: a receiver configured to receive a radio signal containing digitally represented audio data, the radio signal being received from the transmitter on an active channel selected from a plurality of channels, and a digital-to-analogue converter configured to convert the digitally represented audio data into an analogue audio signal. This allows hearing impaired persons to receive a clear audio representing signal which is more difficult for non-intended users to hear.

The receiver device may comprise a connector allowing the receiver device to be connected with a hearing aid. This allows the user to receive the audio without requiring a new electroacoustic transducer.

The receiver device may be configured to receive power from the hearing aid and the receiver device is configured to provide the analogue audio signal to the hearing aid.

The receiver device may be an integrated part in a hearing aid. This provides a very convenient package for the user.

The hearing aid may be configured to mix the analogue audio signal with a hearing aid audio signal originating from the hearing aid. Consequently, the user may hear sound in the users vicinity simultaneously with the transmitted sound.

The receiver device may further comprise decryption means capable of decrypting encrypted digitally represented audio data. Encryption and decryption provides an even more secure way to transfer audio data to the hearing impaired person.

The decryption means may have an associated decryption key to decrypt the digitally represented data, the decryption key matching an encryption key used to encrypt the digitally represented audio data contained in the radio signal. Using decryption keys allows different keys to be used in different circumstances, providing an even higher security.

The receiver device may be configured to receive a control signal. Control data provides a way for the receiver to conveniently receive configurations with minimum user action.

The receiver device may be configured to receive the decryption key from the control signal. Receiving the key using the control signal is simple and user friendly.

The receiver device may be configured to receive an identity of the active channel from the control signal. Receiving the channel id using the control signal is simple and user friendly.

The receiver device may further comprise event presentation means, the event presentation means being configured to generate an analogue audio signal if an event signal is received from the control signal. Receiving the event data using the control signal prevents the event data from interrupting normal audio transmission, e.g. from a television.

The receiver device may be configured to receive at least one control data item selected from a group consisting of the decryption key and the identity of the active channel via a radio signal from a receiver configuration unit.

The receiver device may be configured to receive at least one control data item selected from a group consisting of the decryption key and the identity of the active channel, via an inductive connection from a receiver configuration unit.

The receiver device may be configured to mute the analogue audio signal when the radio signal is of a signal strength less than a threshold value. Consequently, the user will not be bothered with a signal if it is of too poor a quality to hear.

The receiver may be a zero intermediate frequency receiver.

A third aspect of the invention is a system for assisting a hearing impaired user, comprising: a transmitter device configured to transmit data representing audio intended to be heard by a hearing impaired person, the transmitter being capable of being paired with at least one intended receiver, the transmitter comprising: an analogue-to-digital converter configured to convert an analogue audio signal into digitally represented audio data, and a transmitter configured to transmit the digitally represented audio data in a radio signal on an active channel selected from a plurality of channels, and a receiver device configured to receive the data representing audio intended to be heard by the hearing impaired person, the receiver device being capable of being paired with the transmitter device, the receiver device comprising, a receiver configured to receive the radio signal containing the digitally represented audio data, the radio signal being received from the transmitter on the active channel, and a digital-to-analogue converter configured to convert the digitally represented audio data into an analogue audio signal. This allows hearing impaired persons to receive a clear audio representing signal which is more difficult for non-intended users to hear.

The system may comprise at least one transmitter device and a plurality of receiver devices. This allows several users to hear the same transmission.

The system may further comprise a receiver configuration unit, the receiver configuration unit being capable of sending at least one data item to the receiver device.

In this context, "active channel" is to be construed as any channel used to transfer audio data.

Other objectives, features and advantages of the present invention will appear from the following detailed disclosure, from the attached dependent claims as well as from the drawings.

Generally, all terms used in the claims are to be interpreted according to their ordinary meaning in the technical field, unless explicitly defined otherwise herein. All references to "a/an/the [element, device, component, means, step, etc]" are to be interpreted openly as referring to at least one instance of said element, device, component, means, step, etc., unless explicitly stated otherwise. The steps of any method disclosed herein do not have to be performed in the exact order disclosed, unless explicitly stated.

BRIEF DESCRIPTION OF THE DRAWINGS

Embodiments of the present invention will now be described in more detail, reference being made to the enclosed drawings, in which.

DETAILED DESCRIPTION OF THE INVENTION

Figure 1:
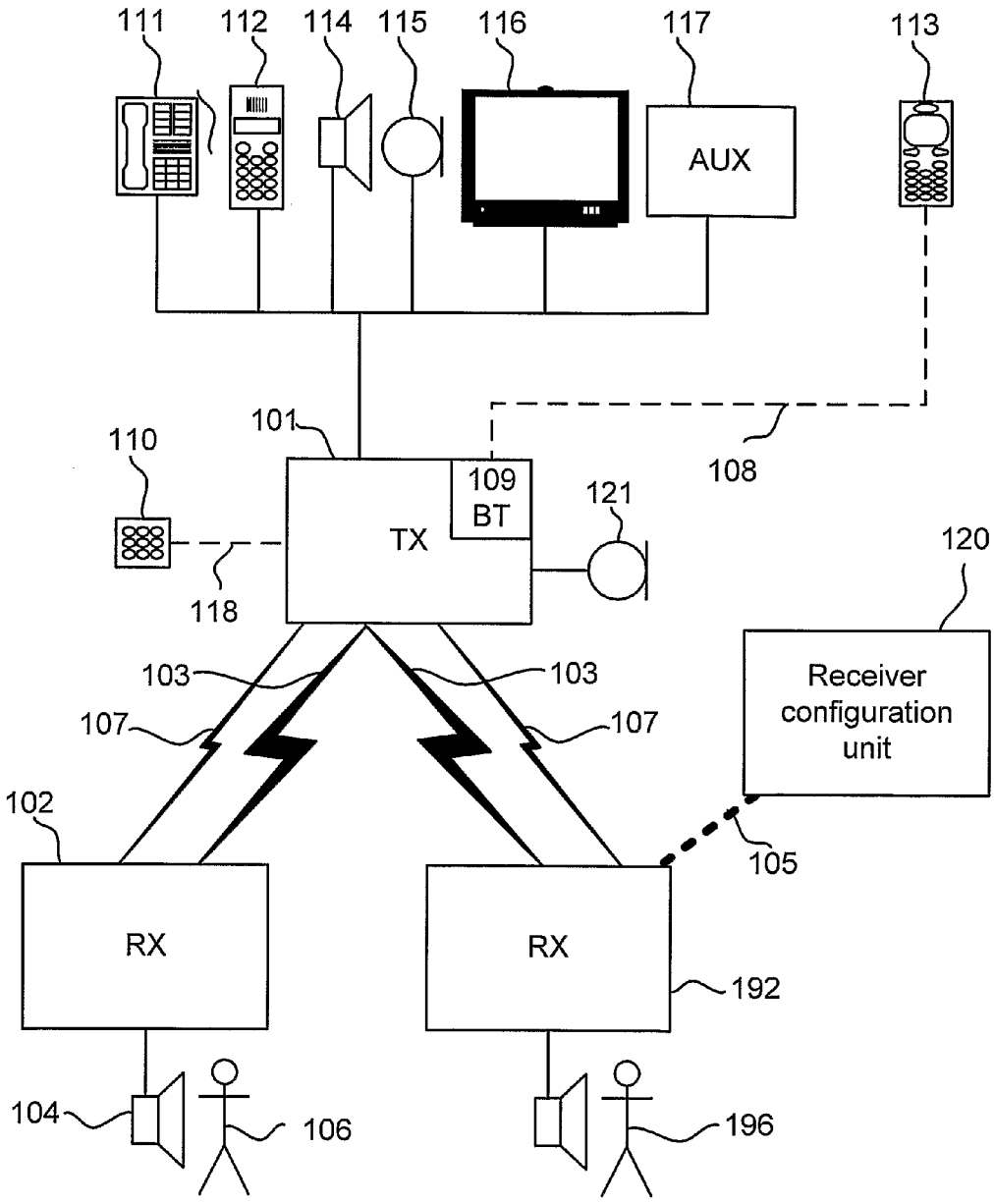
FIG. 1 shows a transmission system for providing audio to people being hearing impaired in an embodiment of the present invention.

FIG. 1 shows a transmission system for providing audio to people being hearing impaired in an embodiment of the present invention. A transmitter device 101 receives audio input from an audio source, such as a telephone 111, a digital enhanced cordless telecommunications (DECT) phone 112, a speaker 114, a microphone (omnidirectional or unidirectional) 115, a television 116, or any other appropriate audio source 117 via an audio in-connector. The connector between the transmitter device 101 and the audio source may be analogue, such as a 3.5 mm jack connector or RCA connectors, or digital, such as a coaxial connector or an optical connector. Additionally or alternatively, a Bluetooth audio connection 108 with a mobile phone 113 is established, utilizing a Bluetooth module 109 in the transmitter device 101. As will be discussed in more detail below, the transmitter device 101 converts the audio signal provided to digital audio data (unless the data input to the transmitter device 101 is already digital), encrypts the audio data, encodes the data, modulates the signal, for example using frequency-shift keying (FSK), quadrature phase-shift keying (QPSK), or minimum-shift keying (MSK), and transmits the data using a radio signal 103 which is transmitted through the air. The radio signal is transmitted on one of several available radio channels. Optionally, the transmitter device 101 may be controlled with a remote control 110 over a wireless interface 118, such as infra-red or radio.

The radio signal 103 is received by a receiver device 102 which is listening to the radio channel used by the transmitter. Also discussed in more detail below, once received, the received device 102 converts the radio signal 103 to digital audio data, decrypts the data and converts the digital audio data to an analogue audio signal again. Subsequently, the receiver device provides the audio signal to an electroacoustic transducer 104, such as a neck loop, an earpiece, a hearing aid or headphones, whereby a user 106 may hear the sound of the original sound source.

One optional use of the transmission system is to use it for event detection. An event detection part 121 is then part of, or is connected to, the transmitter device 101. The event detection part comprises an electroacoustic transducer 121. The transducer 121 may be a simple microphone or similar; it only needs to be able to detect an level of audio in its vicinity. The event detection works as follows. The event detection part is placed in the vicinity of a sound source which generates a sound upon an event which is intended to be detected. This may for example be a door bell, a telephone, or a fire alarm. When the sound source emits a sound, the event detection part detects the sound, and if the level of the audio signal detected is higher than a threshold, an event signal is generated and transmitted to the receiver device 102. The receiver device 102 recognizes the event signal and produces an analogue audio signal which is output to the electroacoustic transducer 104. The event signal itself is preferably transmitted using a control signal, which is explained in more detail below. There are several types of configuration data, or control data, which is useful for the receiver device 102. A first item of control data is the identity of the radio channel used by the transmitter device 101. A second piece of control data is a decryption key, required to decrypt the signal contained in the radio signal 103. The process of providing the radio channel identity, the decryption key or both is referred to as pairing the transmitter device 101 and the receiver device 102. This entails that the particular receiver device 102 is configured to receive audio data from the particular transmitter device 101. If encryption is not used, only the channel identity needs to be configured in the receiver device 102. In this case, the user 106 could manually set the receiver device 102 to receive data on the appropriate channel. However, if encryption is used, there is a need for a way to conveniently transfer the key to the receiver device 102.

A third type of control data is event detection data. This data may include different sound types to be used for particular events and a threshold level above which a sound is considered to be an event.

A fourth type of control data may be basic configuration, including frequency of the control channel (if a separate channel exists in the embodiment in use), time-outs used for sleep modes, etc.

The control data may be transferred over a control channel 107. In a first embodiment, the control channel 107 is be implemented as a separate frequency over which control data is transmitted. The receiver device 102 then periodically checks the control channel for control data. This is preferably solved by having two receivers in the receiver device 102. For example, if a second user 196 enters the room with a second receiver device 192, the second receiver device 192 listens to a preset frequency for control data. Once control data comprising key and channel data is transferred to the second receiver device 192 from the transmitter device 101, the second receiver device 192 tunes to the correct channel and is able to decrypt the audio data with the key provided. The control data may be transmitted from a regular transmitter device 101, or it may be transmitted from a dedicated receiver configuration unit 120. The receiver configuration unit 120 may for example be conveniently placed by the entrance in a room, movie theatre, etc. For example, when the second user 196 enters the room, he/she will see to that the second receiver unit 192 receives the key and channel data for the transmission of audio data which will occur in the room. The second receiver device may subsequently tune to the appropriate channel and is able to decrypt the data with the key provided. One way to limit the range of the transmission from the receiver configuration unit 120 is to utilize a ceramic antenna. In one embodiment, the useful range of the receiver configuration unit 120 is restricted to about 1.5 metres.

The transmission power of the control channel may be limited compared to the main audio channel, only allowing keys to be received within a limited range of the transmitter device 101. Optionally, configuration determining what control channel the receiver device is to listen to may be set during production or may optionally be configurable by the user.

In a second embodiment, control data is transmitted on the same channel that audio data is transmitted. For example, if a second user 196 enters the room, the user 196 configures the receiver device to listen to a particular channel/frequency, which is the channel/frequency used for both audio data and control data in the room. The user of the transmitter device then triggers key data to be transmitted, whereby the second user 196 receives the key data in a time slot over the main channel. Subsequently, both receiver devices 102 and 192 can receive and decrypt audio data from the transmitter device 101.

Alternatively or additionally, the configuration data including key and channel data may be transferred via an inductive connection 105 from the receiver configuration unit 120. The second receiver device may subsequently tune to the appropriate channel and is able to decrypt the data with the key provided.

Figure 2:
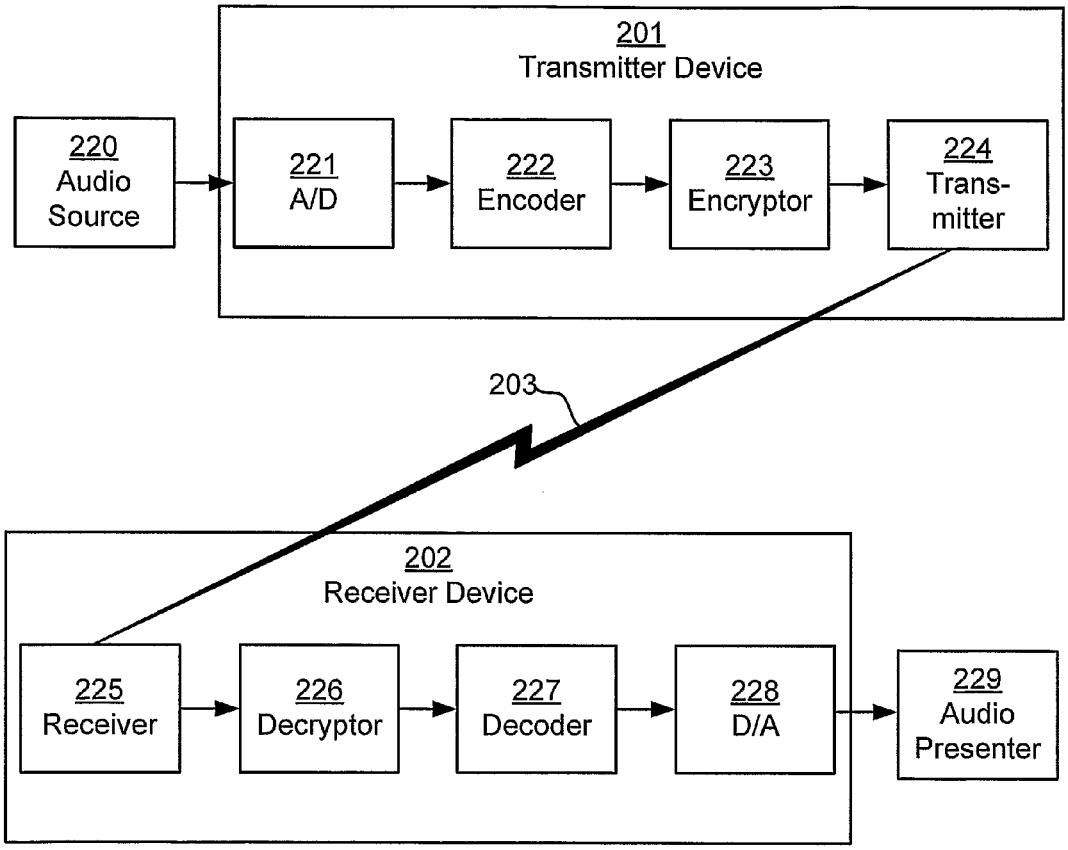
FIG. 2 shows, in more detail, the functional components involved in an audio transmission in a system in an embodiment of the present invention when transmission is up and running.

FIG. 2 shows in more detail the functional components involved in an audio transmission in a system in an embodiment of the present invention when transmission is up and running.

An audio source 220, such as audio sources 111 to 117 in FIG. 1, provides an analogue or digital audio signal to a transmitter device 201, such as transmitter device 101 in FIG. 1. An analogue-to-digital converter (221), also known as an A/D-converter, converts the analogue audio signal to a digital audio signal, provided the input signal is analogue. If the input signal is digital, this function may convert the input digital data to a digital data format which is appropriate for further processing in the transmitter device. In an encoder 222, the digital audio signal is coded into a format which is both efficient in bit rate requirements and resilient to errors that may occur during the transmission. Examples of possible coding schemes are continuously variable slope delta (CVSD), hybrid compounding delta modulation (HCDM), and pulse-code modulation (PCM). For example, using CVSD, bit errors do not have dramatic effects on the sound heard by the user. Once the data is encoded, it may be encrypted using an encryption key in an encrypter 223. The encrypter may use any encryption scheme known in the art, including, but not limited to: DES, AES, 3DES, RSA, DSS, etc. Finally a transmitter 224 within the transmitter device 201 converts the data to a radio signal 203 which is transmitted on a particular channel over the air. As is known in the art, the transmitter 224 itself may include a number of different components, including, band pass filters, amplifiers, mixers, local oscillators, low pass filters, etc. In this embodiment, multiple channels are separated from each other by transmitting on different carrier frequencies, effectively creating a frequency division multiple access system (FDMA). Alternatively, time division multiple access (TDMA) or code division multiple access (CDMA) may be used. In this embodiment, the transmitter is capable of transmitting on the frequencies 804 to 940 MHz, although any desirable frequency may be used within the scope of the present invention.

The radio signal 203 is then picked up by a receiver 225 in a receiver device 202. In one embodiment, the receiver is a zero intermediate frequency receiver, removing the need to handle intermediate frequencies. When using the transmission frequency band mentioned above, antennas may be constructed to be small and integrated in the receiver. For example, dielectric antennas may be used. Similarly to the transmitter 224, the receiver 225 may itself include a number of different components, including, band pass filters, amplifiers, mixers, local oscillators, low pass filters, etc, to extract digital data from the radio signal. Once the digital data is extracted, it is decrypted to a coded audio data signal in the decryptor 226, using a decryption key which matches the encryption key mentioned above. If a symmetric encryption scheme is used, such as DES, AES or 3DES, the decryption key is the same as the encryption key. Once the signal has been decrypted, it is decoded in the decoder 227, according to the encoding scheme used in the transmitter device 201. The decoded digital audio signal is then converted to an analogue audio signal in an digital-to-analogue converter 228, also known as a D/A-converter. Finally, the analogue audio signal is fed to an electroacoustic transducer 229 to be presented to the user. The electroacoustic transducer 229 is typically a neck loop, an earpiece a hearing aid or headphones, but may also be a speaker.

The components in the transmitter device 201 and the receiver device 202 described above should be considered functional components and not necessarily hardware components. The functional components may be implemented as separate hardware entities, where each component may comprise sub-components, on an ASIC, as software code executed in a CPU, DSP or a microcontroller, or a combination of these alternatives.

Figure 3:
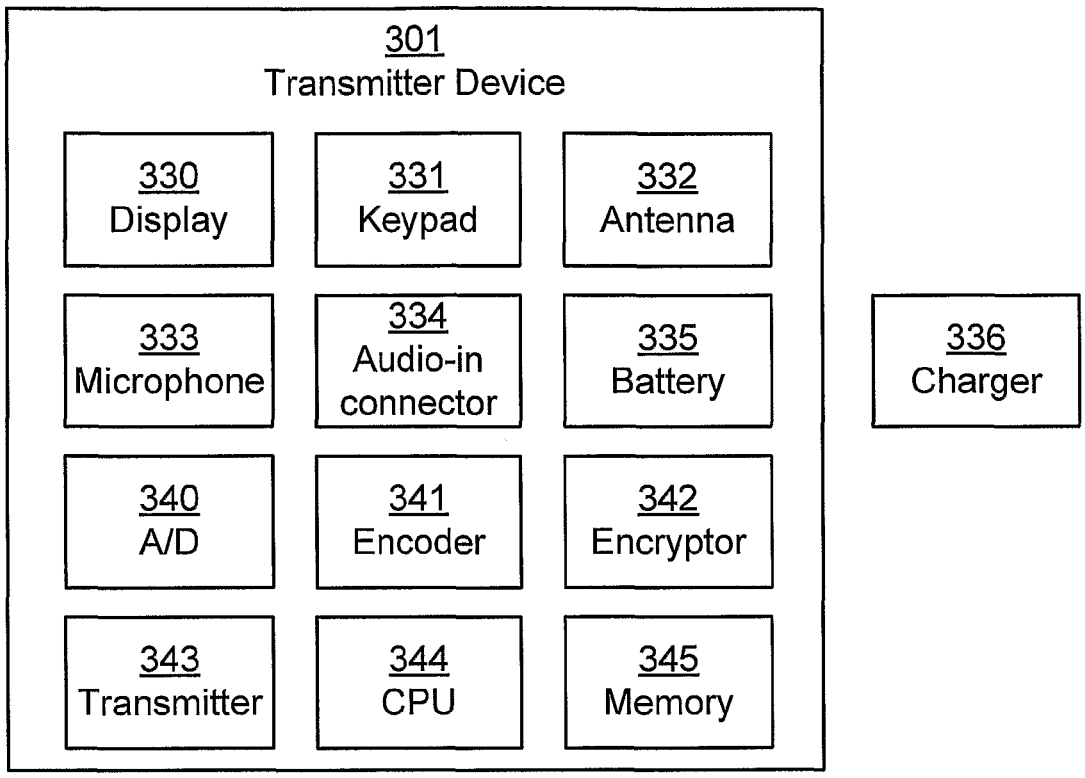
FIG. 3 shows the internal components of a transmitter device according to an embodiment of the present invention.

FIG. 3 shows the internal components of a transmitter device according to an embodiment of the present invention. To allow user interaction, the transmitter device 301 comprises a display 330, for example a Liquid Crystal Display (LCD) or a Thin Film Transistor (TFT) display and a keypad 331. The keypad may be very simple with only a few buttons, allowing the user to navigate through a menu system on the display to perform a large range of functions. An antenna 332, used to transmit radio signals, is preferably integrated in the transmitter device 301 for an attractive look and efficient usage.

A microphone 333 may be integrated in the transmitter device, the microphone being omnidirectional, unidirectional. Alternatively both types of microphones may be provided, either as one configurable microphone or two separate microphones. If two microphones are comprised in the transmitter device 301, their signals may be mixed at a fixed or user defined rate, or one signal may take priority if the level of that signal exceeds a pre-defined level. An audio-in connector 334 allows virtually any type of audio source to be connected to the transmitter device 301. To allow easy operation, a rechargeable or standard type battery 335 is included. If the battery 335 is rechargeable, an external charger 336 may be used to charge the battery.

In this embodiment, the transmitter device further comprises an A/D-converter 340, an encoder 341, an encrypter 342 and a transmitter 343, collectively used to convert the analogue audio signal to a digitally represented audio signal transmitted over radio. A controller 344 being a CPU, microcontroller, DSP or similar, is capable of executing software instructions, for example to transmit key & channel data to the receiver. A memory 345, such as RAM memory, ROM memory, EEPROM memory, flash memory, or any combination thereof is used for various purposes by the controller 344, one of them being for storing data and program instructions, another being to store channel and key data when the transmitter device 301 is put in standby mode.

Figure 4A:
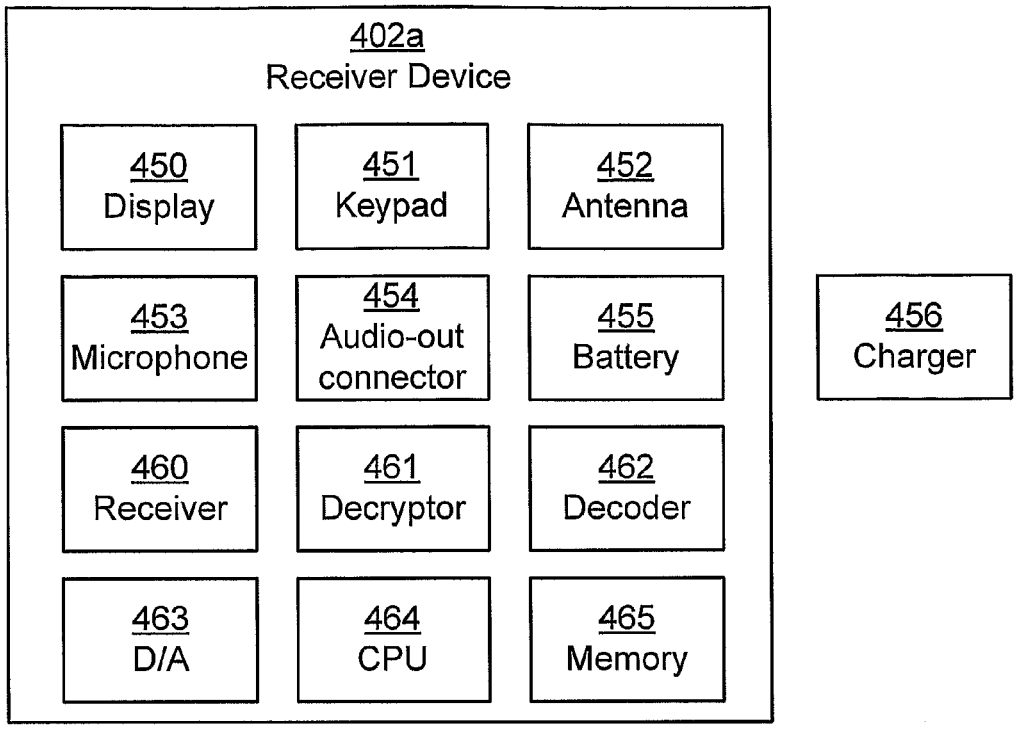
FIG. 4A shows the internal components of a receiver device according to one embodiment of the present invention.

FIG. 4A shows the internal components of a receiver device according to one embodiment of the present invention. This receiver device 402*a* is a separate receiver device 402*a* with a user interface and power supply. The user may for example wear the receiver device 402*a* in a necklace having the function of a neck loop around the neck to allow easy access and usage. The receiver device 402*a* comprises a display 450, for example an LCD or a TFT display, and a keypad 451, making up the user interface. The keypad may be very simple with only a few buttons, allowing the user to navigate through a menu system on the display to perform a large range of functions. Additionally, special purpose keys, such as volume up and volume down keys may be provided. Using the user interface, the user may for example configure the receiver device 402*a* to listen to a particular channel/frequency. An antenna 452, used to receive radio signals, is preferably integrated in the receiver device 402*a* for an attractive look and efficient usage.

A microphone 453 may be integrated in the receiver device 402*a*, the microphone being an omnidirectional microphone, a unidirectional microphone, one microphone being configurable to be either an omnidirectional or a unidirectional microphone, or two microphones for the two uses. This allows the user to not only listen to the transmitted audio signal from e.g. a lecturer, but also hear local audio, listening to people near the user in the audience. The user may, using the user interface, control how transmitted audio and local audio are mixed. Optionally, one signal may be configured to take priority if the level exceeds a pre-defined level. An audio-out connector 454 allows the user to connect an electroacoustic transducer, such as a neck loop, an earpiece, a hearing aid, headphones, or similar to the receiver device 402*a*, whereby the audio is presented to the user. To allow easy operation, a rechargeable or standard type battery 455 is included. If the battery is rechargeable, an external charger 456 may be used to charge the battery.

In this embodiment, the receiver device 402*a* further comprises a receiver 460, a decryptor 461, a decoder 462 and a D/A-converter 463, collectively used to convert the digitally represented audio signal to an analogue audio signal to be provided through the audio-out connector 454. A controller 464, being a CPU, microcontroller, DSP or similar, is capable of executing software instructions, for example to receive key & channel data or to drive the user interface. A memory 465, such as RAM memory, ROM memory, EEPROM memory, flash memory, or any combination thereof, is used for various purposes by the controller 444, one of them being for storing data and program instructions.

Figure 4B:
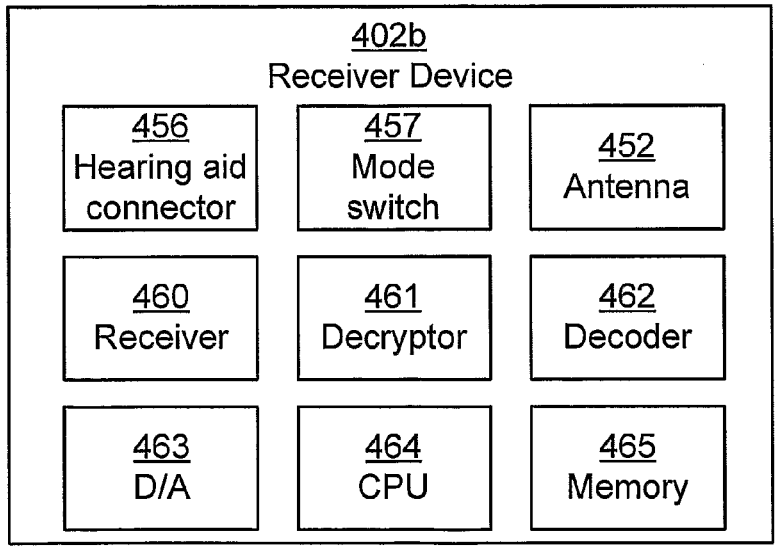
FIG. 4B shows the internal components of a receiver device according to another embodiment of the present invention.

FIG. 4B shows the internal components of a receiver device 402*b* according to another embodiment of the present invention. This receiver device 402*b* is a miniature receiver device 402*b* with only a minimal user interface and no internal power supply. To use the receiver device 402*b*, it is simply connected to an existing hearing aid in a piggy back fashion through a hearing aid connector 456, e.g. a 3 pin connector. Two of the three pins are used for power. The third pin is a signal pin, which is commonly used to transfer the audio signal to the hearing aid but may also be used for other purposes, such as to receive configuration data to the receiver device 402*b*. Consequently, the 3 pin connector may be used to conveniently configure the receiver device 402*b*. Alternatively, the receiver device 402*b* may be integrated inside a hearing aid in one device. A mode switch 457 allows the user to change the operating mode of the receiver device 402*b*. In this embodiment, there are three modes: low volume, high volume, and standby. Low volume and high volume modes are modes where the receiver device 402*b* is in active mode, receiving audio data, and providing an audio signal to the hearing aid either with a low or a high volume, respectively. In the standby mode, the receiver device 402*b* does not receive data but retains key and channel data, allowing the receiver device 402*b* to use this data immediately when the receiver device 402*b* becomes active again. Optionally, the receiver device 402*b* may power down completely to save power if no carrier wave is detected for a specific amount of time, e.g. 10 minutes. In one embodiment, once powered off, the receiver device 402*b* may periodically wake itself up to check if there is a carrier wave available, at which point the receiver device 402*b* would power up and listen to the radio signal. This behaviour may be configured manually or automatically, for example using the 3 pin connector 456 or over a radio or inductive connection with a receiver configuration unit, such as the receiver configuration unit 120 in FIG. 1.

An antenna 452, used to receive radio signals is preferably integrated in the receiver device 402*b* for an attractive look and efficient usage. The antenna may for example be a dielectric antenna.

In this embodiment, the receiver device 402*b* further comprises a receiver 460, a decryptor 461, a decoder 462 and a D/A-converter 463, collectively used to convert the digitally represented audio signal to an analogue audio signal to be provided through the hearing aid connector 456. A controller 464, being a CPU, microcontroller, DSP or similar, is capable of executing software instructions, for example to receive key & channel data or to drive the user interface. A memory 465, such as RAM memory, ROM memory, EEPROM memory, flash memory, or any combination thereof, is used for various purposes by the controller 444, one of them being for storing data and program instructions.

Figure 5:
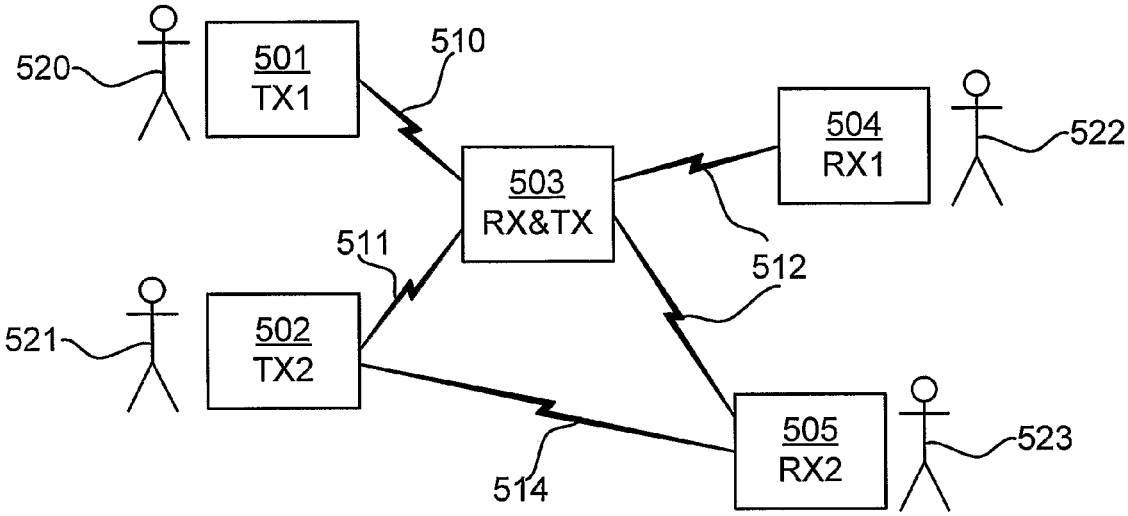
FIG. 5 shows an arrangement in an embodiment of the present invention comprising several transmitters and several receivers.

FIG. 5 shows an arrangement in an embodiment of the present invention comprising several transmitter devices and several receiver devices. To exemplify this arrangement, a scenario with a lecture will be explained. There is a first speaker 520 and a second speaker 521 speaking to a first user 522, being hearing impaired, and a second user 523, also being hearing impaired. Additionally, there will probably be more people in the audience who do not need assistance hearing the speakers (not shown).

A first transmitter device 501 transmits sound captured from the first speaker 520 on a first channel 510. A second transmitter device 502 transmits sound captured from the second speaker 521 on a second channel 511. As explained in more detail above, the sound is converted to digital format, encoded, encrypted and transmitted as a radio signal. In this example, there is a multifunctional unit 503, which may comprise receiver devices, transmitter devices, additional audio inputs including a Bluetooth and phone input, and this device may moreover be controlled via a remote control. The multifunctional unit receives the signals on the two channels 510 and 511 from the first and second transmitter devices, mixes the signals appropriately and transmits on a third channel 512. This provides a system where a first receiver device 504 and a second receiver device 505 receive a mixed audio signal on the common third channel 512. The common audio can therefore easily be controlled to consist of an appropriate mix of potential signals input to the multifunctional unit 503, including other inputs not mentioned here. As explained in more detail above, the signal transmitted on the third channel 512 is received, decrypted, decoded, converted to analogue format and presented by the first and second receiver devices, presenting audio to the first and second users 522, 523, respectively. The arrangement is not limited to two transmitter devices or two receiver devices, as long as the number of channels required for transmission are available; the arrangement may work with an arbitrary number of transmitters or receivers.

If the second speaker 521 needs to speak privately to the second user 523, the second speaker 521 may instruct the second transmitter device 502 to send configuration data, including channel and potentially key data, to the second receiver unit 505. Preferably, the second speaker 521 is close to the second user 523, and the configuration data is transmitted with a range short enough not to be received by the first receiver 504. Once the configuration data has been received by the second receiver device 505, the second receiver device 505 listens to a fourth channel 514 and the second transmitter device transmits on the fourth channel 514. This provides a way for the second speaker 521 to speak with the second user 523 privately.

The invention has mainly been described above with reference to a number of embodiments. However, as is readily appreciated by a person skilled in the art, other embodiments than the ones disclosed above are equally possible within the scope of the invention, as defined by the appended patent claims.

The invention claimed is:

1. A receiver device configured to receive data representing audio intended to be heard by a hearing impaired person, said receiver device being capable of being paired with a transmitter device, said receiver device comprising:

a receiver configured to receive a radio signal containing digitally represented audio data, said radio signal being received from said transmitter on an active channel selected from a plurality of channels, and a digital-to-analogue converter configured to convert said digitally represented audio data into an analogue audio signal, said receiver device being configured to receive a control signal, said receiver device being further configured to receive an identity of said active channel from said control signal, wherein said receiver device comprises a connector allowing said receiver device to be connected with a hearing aid, and said hearing aid is configured to mix said analogue audio signal with a hearing aid audio signal originating from said hearing aid.

2. The receiver device according to claim 1, wherein said receiver device is configured to receive power from said hearing aid and said receiver device is configured to provide said analogue audio signal to said hearing aid.

3. The receiver device according to claim 1, wherein said receiver device is an integrated part in a hearing aid.

4. The receiver device according to claim 1, further comprising decryption means capable of decrypting encrypted digitally represented audio data.

5. The receiver device according to claim 4, wherein said decryption means has an associated decryption key to decrypt said digitally represented data, said decryption key matching an encryption key used to encrypt said digitally represented audio data contained in said radio signal.

6. The receiver device according to claim 1, wherein said receiver device is configured to receive said decryption key from said control signal.

7. The receiver device according to claim 1, wherein said receiver device is configured to receive at least one control data item selected from a group consisting of said decryption key and said identity of said active channel, via a radio signal from a receiver configuration unit.

8. The receiver device according to claim 1 wherein said receiver device is configured to receive at least one control data item selected from a group consisting of said decryption key and said identity of said active channel, via an inductive connection from a receiver configuration unit.

9. The receiver device according to claim 1, wherein said receiver device is configured to mute said analogue audio signal when said radio signal is of a signal strength less than a threshold value.

10. The receiver device according to claim 1, wherein said receiver is a zero intermediate frequency receiver.

11. The receiver device according to claim 1, wherein said receiver device further comprises at least one microphone, said microphone being selected from a group consisting of a unidirectional microphone and an omnidirectional microphone.

12. A system for assisting a hearing impaired user, comprising:

a transmitter device configured to transmit data representing audio intended to be heard by a hearing impaired person, said transmitter being capable of being paired with at least one intended receiver, said transmitter comprising:

an analogue-to-digital converter configured to convert an analogue audio signal into digitally represented audio data, and a transmitter configured to transmit said digitally represented audio data in a radio signal on an active channel selected from a plurality of channels, a control data controller, said control data controller being capable of sending a control signal to said at least one intended receiver, and said transmitter device being capable of transmitting an identity of said active channel to said at least one intended receiver using said control signal, and a receiver device configured to receive said data representing audio intended to be heard by said hearing impaired person, said receiver device being capable of being paired with said transmitter device, said receiver device comprising:

a receiver configured to receive said radio signal containing said digitally represented audio data, said radio signal being received from said transmitter on said active channel, and a digital-to-analogue converter configured to convert said digitally represented audio data into an analogue audio signal, said receiver device being configured to receive a control signal, said receiver device being further configured to receive an identity of said active channel from said control signal, wherein said receiver device comprises a connector allowing said receiver device to be connected with a hearing aid, and said hearing aid is configured to mix said analogue audio signal with a hearing aid audio signal originating from said hearing aid.

13. A system for assisting a hearing impaired user according to claim 12, said system comprising at least one transmitter device and a plurality of receiver devices.

14. A system for assisting a hearing impaired user according to claim 12, said system further comprising a receiver configuration unit, said receiver configuration unit being capable of sending control data to said receiver device.

* * * * *